US008636330B2

(12) United States Patent
Nam et al.

(10) Patent No.: US 8,636,330 B2
(45) Date of Patent: Jan. 28, 2014

(54) REFRIGERATOR DOOR HAVING A PAIR OF SLIDING AND FORCING UNITS

(75) Inventors: Jeong Man Nam, Gwangju (KR); In Yong Hwang, Jeonju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 275 days.

(21) Appl. No.: 12/659,082

(22) Filed: Feb. 24, 2010

(65) Prior Publication Data

US 2010/0229593 A1 Sep. 16, 2010

(30) Foreign Application Priority Data

Mar. 10, 2009 (KR) ..... 10-2009-0020228

(51) Int. Cl.
*A47B 96/04* (2006.01)

(52) U.S. Cl.
USPC ..... 312/402; 312/404; 312/319.8; 312/331

(58) Field of Classification Search
USPC ..... 312/402, 319.1, 331, 404, 330.1, 332, 312/319.8; 62/449; 16/286; 403/344, 345, 403/364
See application file for complete search history.

(56) References Cited

U.S. PATENT DOCUMENTS

| | | | | | |
|---|---|---|---|---|---|
| 1,683,713 | A * | 9/1928 | Eastman | 16/85 |
| 3,261,051 | A * | 7/1966 | Priest | 16/288 |
| 3,516,095 | A * | 6/1970 | Clifton et al. | 4/246.5 |
| 4,821,375 | A * | 4/1989 | Kozon | 16/360 |
| 5,015,048 | A * | 5/1991 | Brunnert | 312/319.1 |
| 5,689,841 | A * | 11/1997 | Black et al. | 4/498 |
| 6,442,799 | B1 * | 9/2002 | Duarte et al. | 16/277 |
| 6,641,239 | B2 * | 11/2003 | Kaiser | 312/404 |
| 6,752,478 | B1 * | 6/2004 | Francz | 312/334.1 |
| 6,799,663 | B2 * | 10/2004 | Dubach | 188/322.22 |
| 2005/0155179 | A1 * | 7/2005 | Duffy | 16/66 |
| 2006/0066189 | A1 * | 3/2006 | Bond et al. | 312/319.1 |
| 2008/0018215 | A1 * | 1/2008 | Carden et al. | 312/404 |
| 2008/0265727 | A1 * | 10/2008 | Kohlman et al. | 312/319.1 |
| 2009/0045713 | A1 * | 2/2009 | Kunkle et al. | 312/402 |
| 2009/0295262 | A1 * | 12/2009 | Ward et al. | 312/334.44 |

FOREIGN PATENT DOCUMENTS

| | | | |
|---|---|---|---|
| EP | 1635025 | A1 * | 3/2006 |
| JP | 2006-266586 | | 10/2006 |

* cited by examiner

*Primary Examiner* — Darnell Jayne
*Assistant Examiner* — Andres F Gallego
(74) *Attorney, Agent, or Firm* — Staas & Halsey LLP

(57) ABSTRACT

A refrigerator having an installation configuration of a freezing compartment door to be opened or closed in a semi-automatic manner. The refrigerator includes a body having a storage compartment, a door to open or close the storage compartment, and a door control device to complete an opening/closing operation of the door by providing the door with a thrust force.

11 Claims, 9 Drawing Sheets

REFRIGERATOR DOOR HAVING A PAIR OF SLIDING AND FORCING UNITS

CROSS-REFERENCE TO RELATED APPLICATIONS

This application claims the benefit of Korean Patent Application No. 2009-0020228, filed on Mar. 10, 2009 in the Korean Intellectual Property Office, the disclosure of which is incorporated herein by reference.

BACKGROUND

1. Field

Embodiments of the present invention relate to a refrigerator in which a door is opened or closed in a semi-automatic manner under generation of a damping force.

2. Description of the Related Art

A refrigerator is an apparatus in which cold air generated via a refrigeration cycle is supplied into a storage compartment to keep items stored therein fresh. The storage compartment may include a refrigerating compartment and a freezing compartment.

Refrigerators may be classified into various shapes based on positions of a refrigerating compartment and freezing compartment. For example, there are a top-mount type refrigerator in which a freezing compartment is located at an upper side of a refrigerating compartment and, conversely, a bottom-mount type refrigerator in which a freezing compartment is located at a lower side of a refrigerating compartment.

In the bottom-mount type refrigerator, the freezing compartment located in the lower side may be smaller than the refrigerating compartment located in the upper side. In this case, providing the freezing compartment with a sliding type opening/closing door may assure more effective use of the freezing compartment.

SUMMARY

Therefore, it is an aspect of the present invention to provide a refrigerator having an improved door installation configuration in which a door is opened or closed in a semi-automatic manner under generation of a damping force.

It is another aspect of the present invention to provide a refrigerator, which reduces generation of noise and friction upon opening or closing of a door, resulting in an improved door opening/closing operation.

Additional aspects of the invention will be set forth in part in the description which follows and, in part, will be apparent from the description, or may be learned by practice of the invention.

The foregoing and/or other aspects of the present invention may be achieved by providing a refrigerator including a body having a storage compartment, a door to open or close the storage compartment, and at least one damping unit to provide a force in a door opening direction during opening of the door to thereby complete an opening operation of the door, and to provide a force in a door closing direction during closing of the door to complete a closing operation of the door.

The damping unit may provide a force in an opposite direction of the door opening direction during opening of the door to reduce an operation speed of the door and a force in an opposite direction of the door closing direction during closing of the door to reduce an operation speed of the door.

The damping unit may be installed to rotationally reciprocate in linkage with the door.

The damping unit may reciprocate between a first position where an end of the damping unit is located in front of an opposite end and a second position where the end of the damping unit is located behind the opposite end.

The refrigerator may further include a sliding unit to perform sliding reciprocating motion in linkage with the door, and the damping unit may rotationally reciprocate in linkage with the sliding unit.

An angle between the damping unit and the sliding unit may be less or greater than 90 degrees based on rotational reciprocating motion of the damping unit.

The angle between the sliding unit and the damping unit may be greater than 90 degrees when the opening operation of the door is completed, and may be less than 90 degrees when the closing operation of the door is completed.

The damping unit may be tilted in a direction toward or away from the sliding unit based on rotational reciprocating motion of the damping unit.

The sliding unit may include a plurality of rails installed to slide relative to each other, and the damping unit may include a cylinder and a rod installed to move relative to each other.

The refrigerator may further include a first shaft unit to couple an end of the damping unit to the sliding unit to provide the end of the damping unit with at least one degree of freedom, and a second shaft unit to couple an opposite end of the damping unit to the body to provide the opposite end of the damping unit with at least one degree of freedom.

The damping unit may include a shaft hole provided in the end thereof, and the first shaft unit may include a shaft boss rotatably inserted into the shaft hole and a shaft bolt fastened with the shaft boss to prevent the shaft boss from being released from the shaft hole.

The damping unit may include a rod fixing portion provided in the opposite end thereof, and the second shaft unit may include a socket coupled with the rod fixing portion, a ball screw to allow movement of the socket, and a bracket to fix the ball screw.

The socket may include a movement space to assure movement thereof on the ball screw.

The at least one damping unit may include a pair of damping units installed opposite each other in the storage compartment, and the refrigerator may further include a balance regulating unit to link the pair of damping units to each other, to allow simultaneous operation of both side ends of the door.

The balance regulating unit may include a balance regulating member to connect the pair of damping units to each other.

The refrigerator may further include a pair of sliding units installed opposite each other in the storage compartment and adapted to slide in linkage with the damping unit, and a balance regulating unit to link the pair of sliding units to each other, to allow simultaneous operation of both side ends of the door.

The foregoing and/or other aspects of the present invention may also be achieved by providing a refrigerator including a body having a storage compartment, a door to open or close the storage compartment, a sliding unit to linearly reciprocate in linkage with the door, and a damping unit to rotationally reciprocate in linkage with the sliding unit, and the damping unit operates the sliding unit via rotational reciprocating motion thereof, to move the door forward or rearward.

The damping unit may brake the sliding unit to reduce an opening/closing operation speed of the door.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENT

Figure 1:
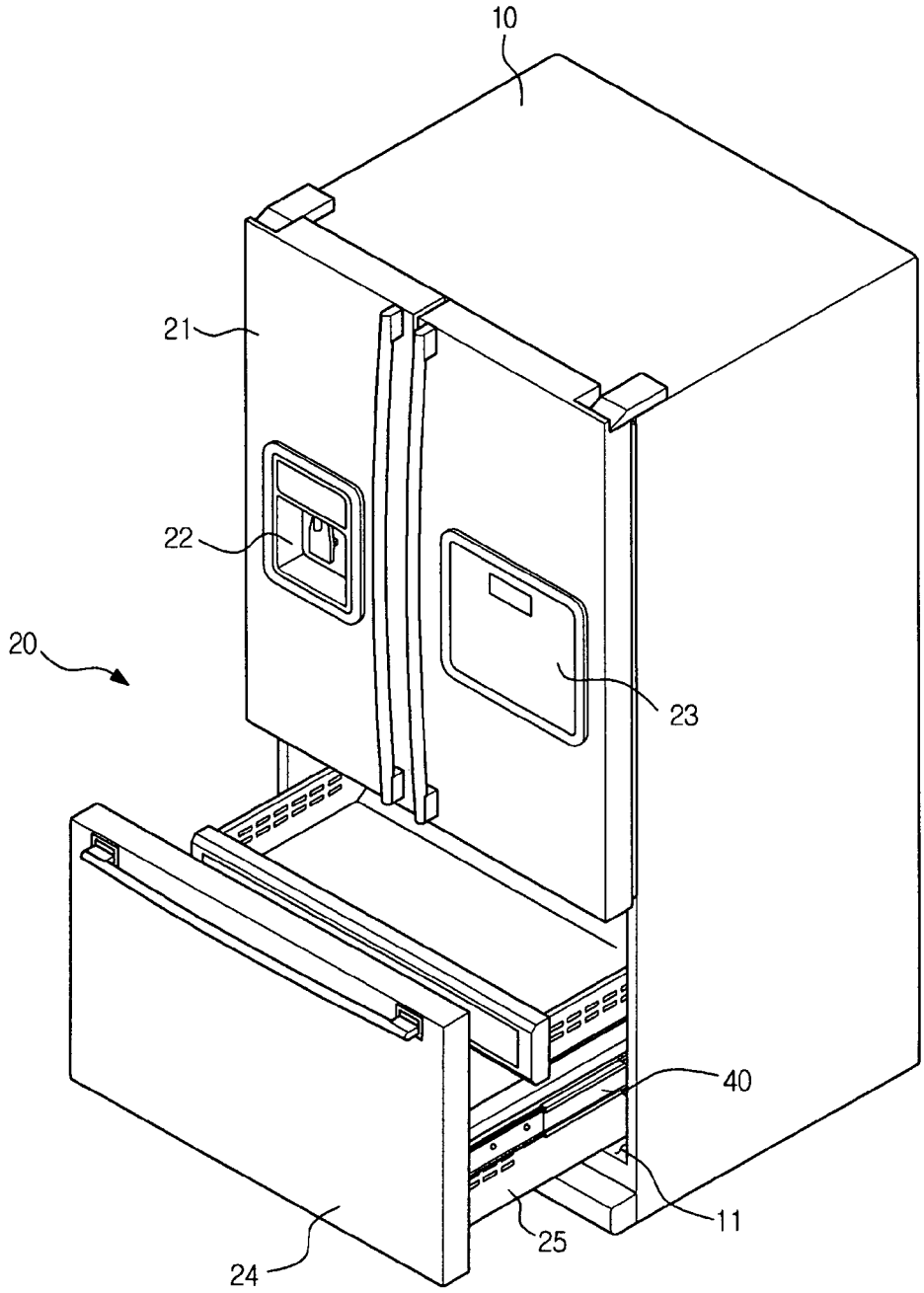
FIG. 1 is a view illustrating a refrigerator according to an exemplary embodiment of the present invention.

Reference will now be made in detail to the embodiment, an example of which is illustrated in the accompanying drawings, wherein like reference numerals refer to the like elements throughout. The embodiment is described below to explain the present invention by referring to the figures.

FIG. 1 is a view illustrating a refrigerator according to an exemplary embodiment of the present invention.

As shown in FIG. 1, the refrigerator according to the embodiment of the present invention may include a body 10 having a storage compartment (including of a refrigerating compartment (not shown) and a freezing compartment 11), and a door 20 to open or close the storage compartment. More particularly, the refrigerator of a bottom-mount type (as shown in FIG. 1) includes the refrigerating compartment (not shown) defined in an upper part of the body 10, a refrigerating compartment door 21 to open or close the refrigerating compartment, the freezing compartment 11 defined in a lower part of the body 10, and a freezing compartment door 24 to open or close the freezing compartment 11.

The refrigerating compartment door 21 may be of a double door type. Specifically, the refrigerating compartment door 21 may include a pair of doors pivotably coupled to left and right sides of the body 10, the doors being adapted to open or close the refrigerating compartment (not shown) via rotational reciprocating motion thereof. The refrigerating compartment door 21 may be provided with a dispenser 22, a home-bar 23, etc.

The freezing compartment door 24 may be of a drawer type. The freezing compartment door 24 is forwardly or rearwardly movable to or from the body 10 and is adapted to open or close the freezing compartment 11 via linear reciprocating motion thereof.

More particularly, the drawer type freezing compartment door 24 may be attached to a basket 25 provided at a rear side thereof, to slide along with the basket 25. Here, as shown in FIG. 1, a plurality of baskets 25 may be arranged one above another in a sliding manner. It is noted that, when a weight of the basket 25 increases due to items received therein, this may exert a relatively large frictional force on the freezing compartment door 24 sliding along with the basket 25. This may cause the freezing compartment door 24 to incompletely open or close the freezing compartment 11. Hereinafter, an installation configuration of the freezing compartment door 24 to completely open or close the freezing compartment 11 in a semi-automatic manner will be described.

Figure 2:
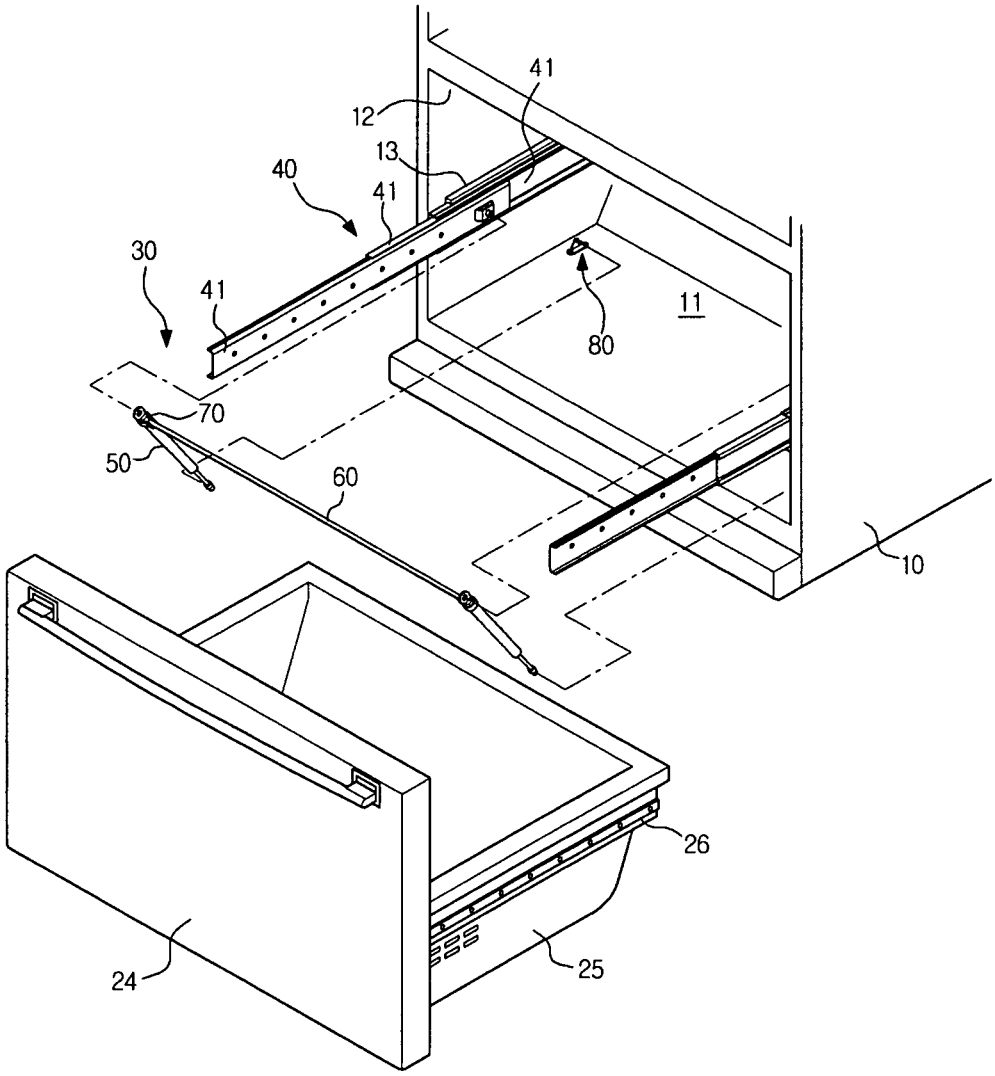
FIG. 2 is a view illustrating a freezing compartment door and a door control device according to the embodiment of the present invention.
Figure 3:
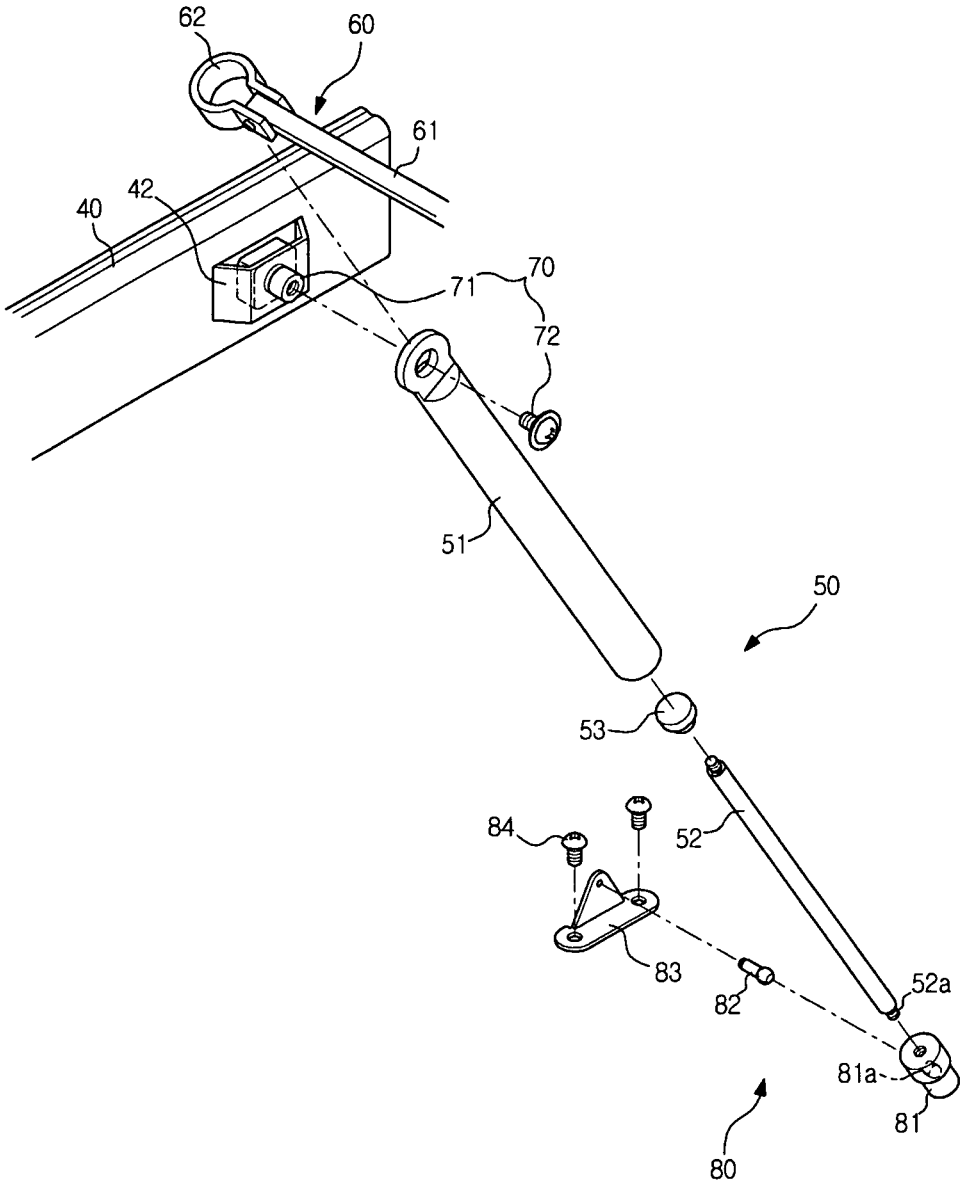
FIG. 3 is a view of the door control device according to the embodiment of the present invention.

FIG. 2 is a view illustrating the freezing compartment door and a door control device according to the embodiment of the present invention, and FIG. 3 is a view of the door control device according to the embodiment of the present invention.

As shown in FIGS. 1 to 3, the refrigerator according to the embodiment of the present invention may include a door control device 30, which controls the freezing compartment door 24 thus allowing the freezing compartment door 24 to open or close the freezing compartment 11 in a semi-automatic manner. Here, the term "semi-automatic" means that opening of the freezing compartment door 24 is automatically completed when a user opens the freezing compartment door 24 to some extent, and closing of the freezing compartment door 24 is automatically completed when the user closes the freezing compartment door 24 to some extent.

The door control device 30 may include a sliding unit 40, a damping unit 50, a balance regulating unit 60, a first shaft unit 70, and a second shaft unit 80.

The sliding unit 40 may include a plurality of rails 41, which slide relative to each other. The sliding unit 40 is variable in length via sliding movement of the plurality of rails 41. That is, a total length of the sliding unit 40 varies as the plurality of rails 41 slides. The freezing compartment door 24 operates in linkage with the sliding unit 40 and therefore, may linearly reciprocate forward or rearward as the length of the sliding unit 40 varies. In addition, the sliding unit 40 may include rollers (not shown), etc.

The sliding unit 40 is installed between the body 10 and the freezing compartment door 24. One side of the sliding unit 40 is installed to a first bracket 13 provided at an inner shell 12 of the body 10, and the other side of the sliding unit 40 is installed to a second bracket 26 provided at the basket 25. In the present embodiment, a pair of the sliding units 40 may be symmetrically installed in the freezing compartment 11.

The damping unit 50 provides the sliding unit 40 with various forces, to slide the sliding unit 40 and to regulate a sliding speed of the sliding unit 40. More specifically, the damping unit 50 may include a cylinder 51, and a rod 52 partially inserted into the cylinder 51 to move relative to the cylinder 51. The cylinder 51 is filled with fluid to create a predetermined hydraulic pressure, and a piston 53 having a fine hole is received in the cylinder 51. The damping unit 50 has a force to move the cylinder 51 and rod 52 far away from each other by the hydraulic pressure of the fluid. In addition, as the fluid passes through the fine hole of the piston 53 during relative motion of the cylinder 51 and rod 52, the damping unit 50 has a force to reduce a relative motion speed of the cylinder 51 and rod 52. With these forces, the damping unit 50 may provide the sliding unit 40 with a drive force to allow the sliding unit 40 to slide by the predetermined hydraulic pressure and also, may provide the sliding unit 40 with a damping force to reduce a sliding speed of the sliding unit 40 by use of the piston 53. With the damping force of the damping unit 50, the freezing compartment door 24 may realize a smooth opening/closing operation and may be slowly opened or closed thus resulting in reduction in noise, etc.

The damping unit 50 operates in linkage with the sliding unit 40. The damping unit 50 performs rotational reciprocating motion during linear reciprocating motion of the sliding unit 40. One side of the damping unit 50 is coupled to the sliding unit 40 by the first shaft unit 70, and the other side of the damping unit 50 is coupled to the inner shell 12 of the body 10 by the second shaft unit 80. In the present embodiment, a pair of the damping units 50 may be symmetrically installed in the freezing compartment 11.

The first shaft unit 70 may include a shaft boss 71 and a shaft bolt 72 fastened with the shaft boss 71. The shaft boss 71 is fixed to a shaft fixture 42 of the sliding unit 40 and is inserted into a shaft hole 51*a* of the damping unit 50. The shaft bolt 72 is fastened with the shaft boss 71, thus preventing the shaft boss 71 from being released from the shaft hole 51*a*. Once the shaft boss 71 is inserted into the shaft hole 51*a*, the damping unit 50 may rotationally reciprocate with one degree of freedom.

Figure 4:
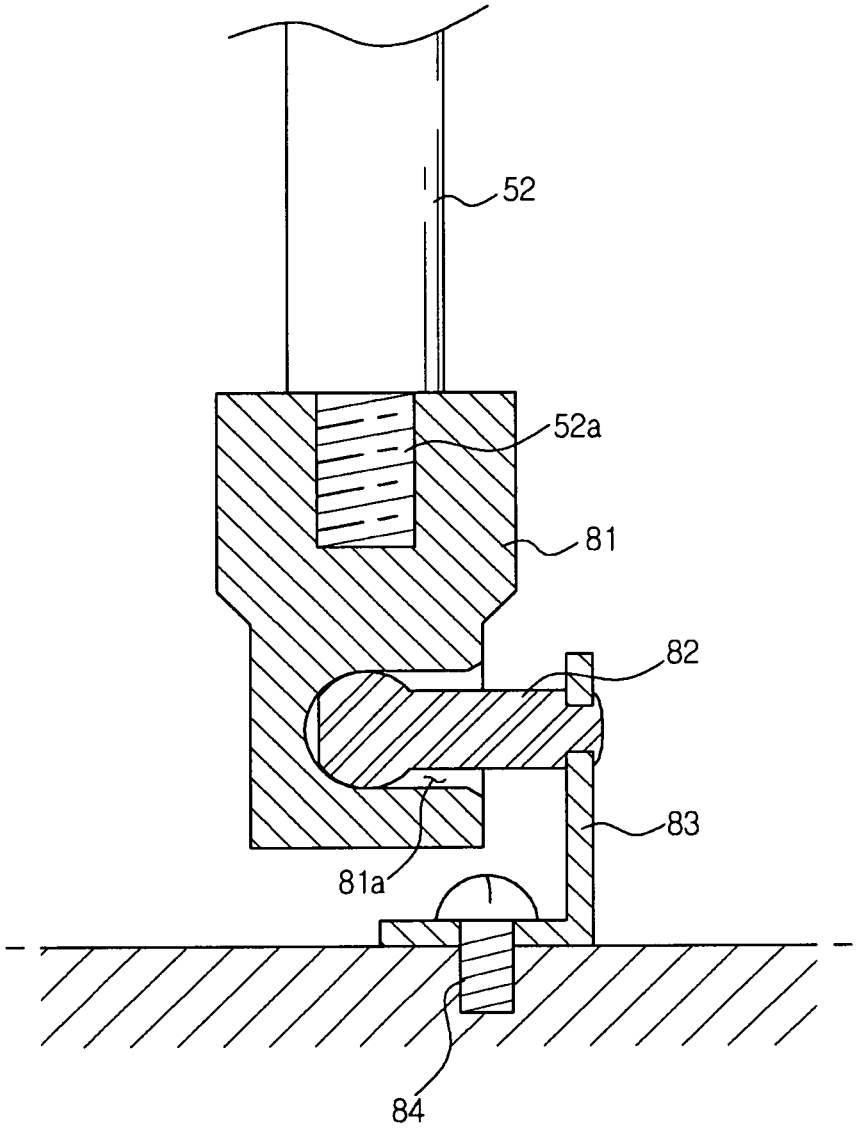
FIG. 4 is a view illustrating a second shaft unit according to the embodiment of the present invention.

FIG. 4 is a view illustrating the second shaft unit according to the embodiment of the present invention.

As shown in FIGS. 1 to 4, the second shaft unit 80 according to the embodiment of the present invention may include a socket 81, a ball shaft 82, and a shaft bracket 83. The socket 81 is fastened with a rod fixing portion 52*a* of the damping unit 50. The ball shaft 82 and shaft bracket 83 may be coupled with each other to define an integral body. The integrally coupled ball shaft 82 and shaft bracket 83 are fixed to the inner shell 12 of the body 10 by shaft bolts 84. Here, the socket 81 is rotatable while being supported by the ball shaft 82. In particular, the socket 81 internally defines a movement space 81*a* and is rotatable in several directions with multiple degrees of freedom. This very efficiently removes effects due to twisting of the damping unit 50. That is, even if the damping unit 50 is subjected to twisting during opening or closing of the freezing compartment door 24, the socket 81 may be rotated with multiple degrees of freedom, thus preventing twisting damage to the damping unit 50.

When the pair of sliding units 40 symmetrically installed in the freezing compartment 11 is operated respectively and also, the pair of damping units 50 symmetrically installed in the freezing compartment 11 is operated respectively, the freezing compartment door 24 may fail to maintain horizontal balance during opening or closing thereof. For this reason, a balance regulating member 61 is provided to connect the pair of damping units 50 to each other and serves to maintain horizontal balance of the freezing compartment door 24 during opening or closing of the freezing compartment door 24. The balance regulating member 61 may be formed of a rigid body to resist twisting. The balance regulating member 61 is coupled to the cylinder 51 of the damping unit 50 by a bracket 62.

Of course, when the balance regulating member 61 is provided to connect the pair of sliding units 40, the balance regulating member 61 may keep horizontal balance of the freezing compartment door 24 during opening or closing of the freezing compartment door 24.

Figure 5:
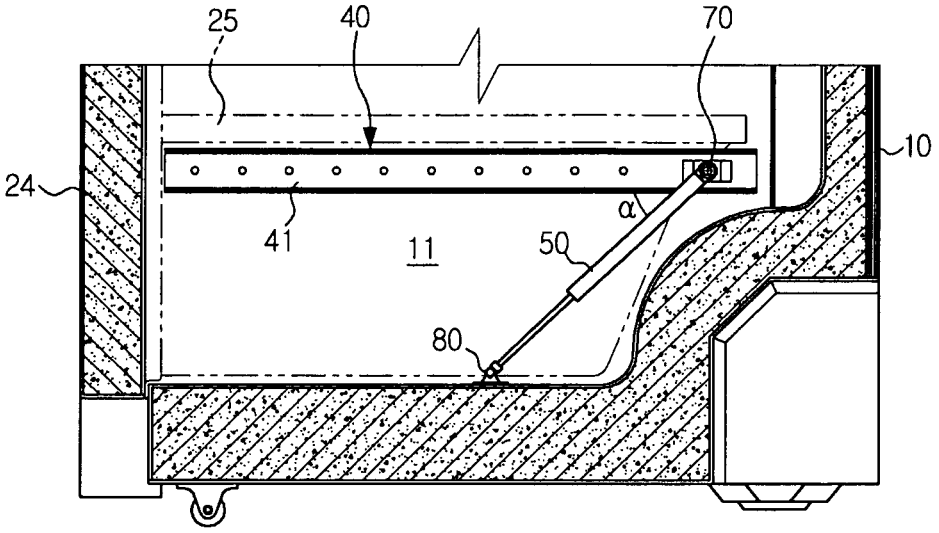
FIG. 5 is a view illustrating a completely closed state of the freezing compartment door according to the embodiment of the present invention.
Figure 7:
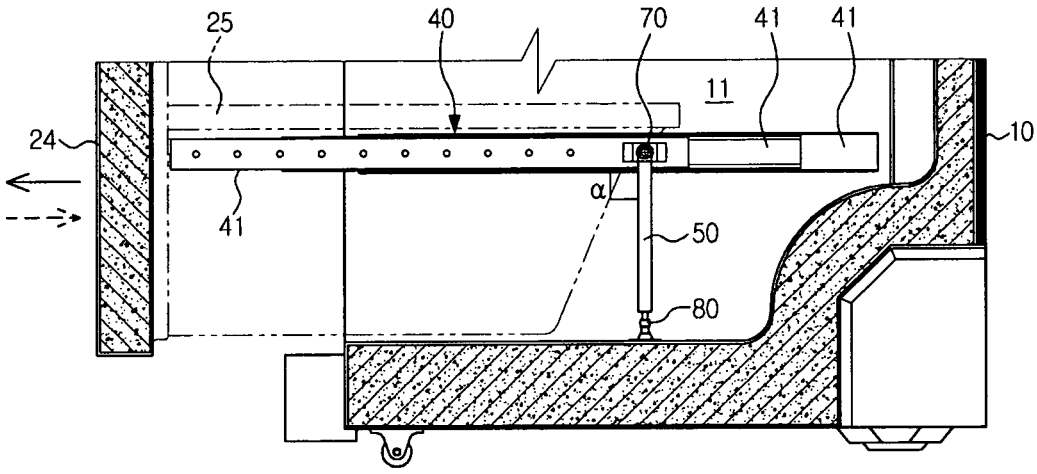
Figure 8:
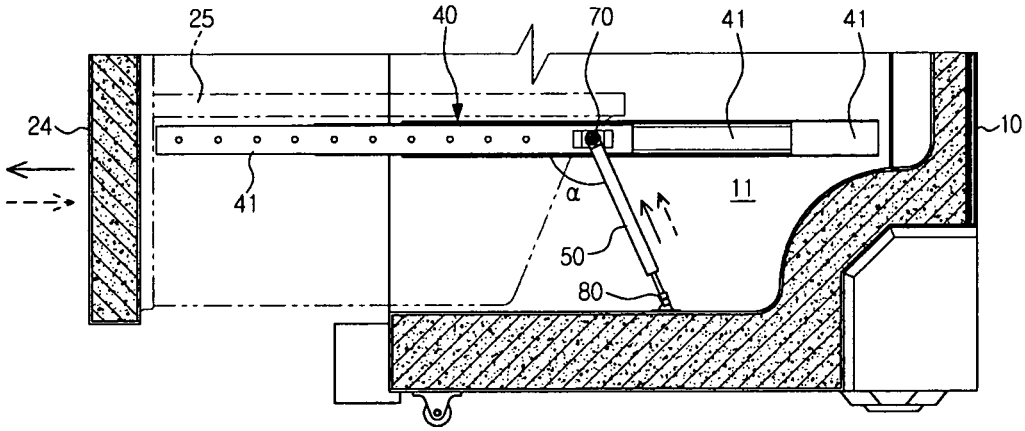
Figure 9:
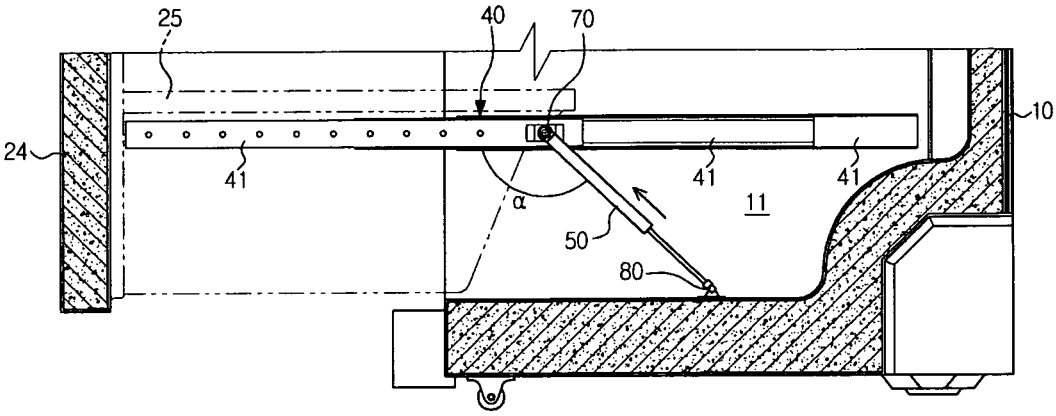
FIG. 9 is a view illustrating a completely opened state of the freezing compartment door according to the embodiment of the present invention.

FIGS. 5 to 9 illustrate an opening or closing operation of the freezing compartment door according to the embodiment of the present invention. More particularly, FIG. 5 illustrates a completely closed state of the freezing compartment door and FIG. 9 illustrates a completely opened state of the freezing compartment door.

As shown in FIGS. 1 to 9, the door control device 30 according to the embodiment of the present invention provides the freezing compartment door 24 with a thrust force. Specifically, the door control device 30 provides a force to continuously push the freezing compartment door 24 in a movement direction of the freezing compartment door 24. For example, as shown in FIG. 5, as the freezing compartment door 24 is forced in a closing direction thereof by the predetermined hydraulic pressure of the damping unit 50, closing of the freezing compartment door 24 is automatically completed. In addition, as shown in FIG. 9, as the freezing compartment door 24 is forced in an opening direction thereof by the predetermined hydraulic pressure of the damping unit 50, opening of the freezing compartment door 24 is automatically completed.

This is because the sliding unit 40 and damping unit 50 according to the embodiment of the present invention are installed such that an included angle $\alpha$ between the sliding unit 40 and the damping unit 50 is less than 90°, or greater than 90° based on rotational reciprocating motion of the damping unit 50. For example, when the freezing compartment door 24 is closed as shown in FIG. 5, the included angle $\alpha$ between the sliding unit 40 and the damping unit 50 is less than 90°. When the freezing compartment door 24 is opened as shown in FIG. 9, the included angle $\alpha$ between the sliding unit 40 and the damping unit 50 is greater than 90°. In the embodiment of the present invention, varying the included angle $\alpha$ between the sliding unit 40 and the damping unit 50 may vary a direction of force to be applied to the freezing compartment door 24 by the damping unit 50. Thus, when a user opens the freezing compartment door 24 to some extent such that the included angle $\alpha$ between the sliding unit 40 and the damping unit 50 is greater than 90°, an opening operation of the freezing compartment door 24 may be completed automatically. On the contrary, when the user closes the freezing compartment door 24 to some extent such that the included angle $\alpha$ between the sliding unit 40 and the damping unit 50 is less than 90°, a closing operation of the freezing compartment door 24 may be completed automatically. In conclusion, in the refrigerator according to the embodiment of the present invention, the door 24 may be automatically opened or closed by an improved installation configuration of the damping unit 50. This eliminates a need for a separate device to automatically open or close the door 24 rather than the damping unit 50, thus reducing configuration complexity.

In addition, the door control device 30 provides the freezing compartment door 24 with a damping force. Specifically, the door control device 30 provides a force in an opposite direction of a movement direction of the freezing compartment door 24. This is because the cylinder 51 and rod 52 of the damping unit 50 move relative to each other in linkage with sliding motion of the rails 41 of the sliding unit 40. If the cylinder 51 and rod 52 move relative to each other, the fluid in the cylinder 51 undergoes pressure variation while passing through the fine hole of the piston 53, thus causing a reduction in relative motion speed of the cylinder 51 and rod 52. With this operation, the door control device 30 provides the freezing compartment door 24 with a damping force, thereby reducing an opening/closing speed of the freezing compartment door 24.

Now, an opening/closing operation of the freezing compartment door according to the embodiment of the present invention will be described with reference to FIGS. 1 to 9. Here, a movement direction and a force direction of the freezing compartment door 24 during opening of the freezing compartment door 24 are represented by solid lines, and a movement direction and force direction of the freezing compartment door 24 during closing of the freezing compartment door 24 are represented by dashed lines.

Figure 6:
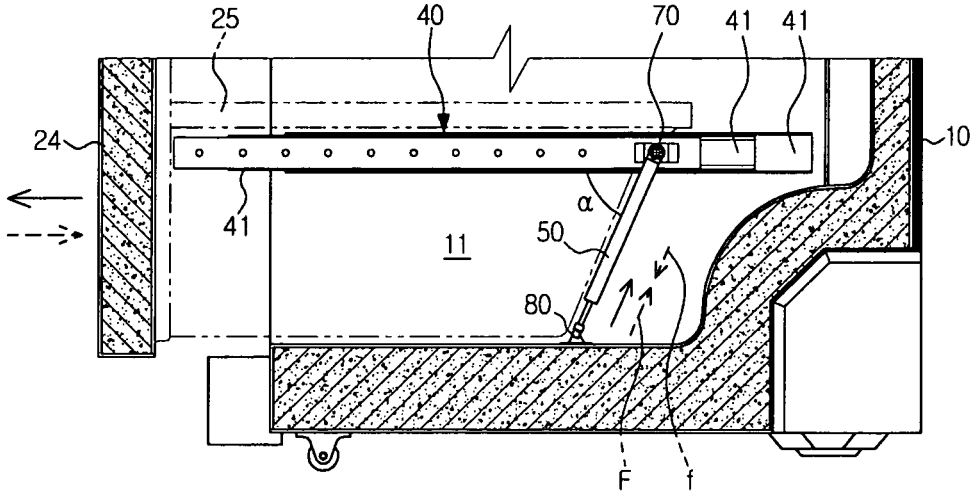
FIGS. 6 to 8 are views illustrating an opening or closing operation of the freezing compartment door according to the embodiment of the present invention.

To open the freezing compartment door 24, the user forces the freezing compartment door 24 in a closed state of the freezing compartment door 24 as shown in FIG. 5, to pull the freezing compartment door 24 away from the freezing compartment 11. The freezing compartment door 24 slides forward and is opened via operation of the sliding unit 40 as shown in FIG. 6. Even if the freezing compartment door 24 is suddenly pulled out upon receiving an excessive user force, as shown in FIG. 6, the door control device 30 provides the freezing compartment door 24 with a damping force, thereby allowing the freezing compartment door 24 to be opened slowly. In this case, the included angle α between the sliding unit 40 and the damping unit 50 is less than 90°.

Thereafter, the included angle α between the sliding unit 40 and the damping unit 50 passes 90°, as shown in FIG. 7, via continuous opening of the freezing compartment door 24. Then, when the included angle α between the sliding unit 40 and the damping unit 50 is greater than 90° as shown in FIG. 8, the door control device 30 provides the freezing compartment door 24 with a thrust force, thereby enabling automatic opening of the freezing compartment door 24. Thereafter, the opening of the freezing compartment door 24 is automatically completed as shown in FIG. 9, even if the user applies no force. In addition, since the door control device 30 continuously provides the freezing compartment door 24 with the thrust force even after the freezing compartment door 24 is completely opened, the door control device 30 also functions to keep the freezing compartment door 24 in the opened state.

On the contrary, to close the freezing compartment door 24, the user forces the freezing compartment door 24 in the opened state of the freezing compartment door 24 as shown in FIG. 9, to push the freezing compartment door 24 into the freezing compartment 11. The freezing compartment door 24 slides rearward and is closed via operation of the sliding unit 40. Even if the freezing compartment door 24 is suddenly pushed inward upon receiving an excessive user force, as shown in FIG. 8, the door control device 30 provides the freezing compartment door 24 with a damping force, thereby allowing the freezing compartment door 24 to be closed slowly. In this case, the included angle α between the sliding unit 40 and the damping unit 50 is greater than 90°.

Thereafter, the included angle α between the sliding unit 40 and the damping unit 50 passes 90°, as shown in FIG. 7, via continuous closing of the freezing compartment door 24. Then, when the included angle α between the sliding unit 40 and the damping unit 50 is less than 90° as shown in FIG. 6, the door control device 30 provides the freezing compartment door 24 with a thrust force F, thereby enabling automatic closing of the freezing compartment door 24. Thereafter, the closing of the freezing compartment door 24 is automatically completed as shown in FIG. 5, even if the user applies no force. In addition, since the door control device 30 continuously provides the freezing compartment door 24 with a damping force, even if the user suddenly additionally forces the freezing compartment door 24 to close the freezing compartment door 24, the freezing compartment door 24 suffers little damage due to serious collision with the body 10.

Meanwhile, the balance regulating member 61 maintains horizontal balance of the freezing compartment door 24 during opening or closing of the freezing compartment door 24, thereby assuring smooth opening/closing of the freezing compartment door 24. Also, since the damping unit 50 is rotatable with multiple degrees of freedom via the second shaft unit 80 even if the damping unit 50 is subjected to twisting during opening or closing of the freezing compartment door 24, the damping unit 50 may have an extremely low possibility of twisting damage.

As is apparent from the above description, a refrigerator according to the embodiment of the present invention may exert a thrust force during opening or closing of a door, thus allowing opening or closing of the door to be completed automatically.

Further, exerting a damping force during opening or closing of the door may assure a smooth door opening or closing operation.

Furthermore, a simplified device configuration may assure a reduction in frictional area, thus resulting in enhanced operational performance and reduced noise generation.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

a body;

a storage compartment defined in the body and having an open front side;

a door to open or close the open front side of the storage compartment;

a basket provided at the rear of the door;

a sliding unit provided between a lateral wall of the body and a lateral wall of the basket to support the door and the basket sliding between a first position in which the door and the basket are fully pulled and a second position in which the door and the basket are fully pushed;

a pair of forcing units installed opposite each other in the storage compartment applying force to the door and the basket in the direction in which the door and the basket move toward the first position or in the direction in which the door and the basket move toward the second position depending on positions of the door and the basket, the forcing units being provided below the sliding unit between the lateral wall of the basket and the lateral wall of the body; wherein each forcing unit includes a cylinder and a rod installed to move relative to each other; and a balance regulating unit linking the pair of forcing units to each other to allow simultaneous operation of both side ends of the door, the balance regulating unit comprising a balance regulating member formed of a rigid body to resist twisting and a pair of brackets to couple the balance regulating member to the pair of forcing units, wherein the balance regulating member directly connects the cylinders of the pair of forcing units to each other and serves to maintain horizontal balance of the door during opening or closing of the door.

2. The refrigerator according to claim 1, wherein the forcing unit rotationally reciprocates in linkage with the sliding unit.

3. The refrigerator according to claim 2, further comprising:

a first shaft unit to couple an end of the forcing unit to the sliding unit to provide the end of the forcing unit with at least one degree of freedom; and a second shaft unit to couple an opposite end of the forcing unit to the body to provide the opposite end of the forcing unit with at least one degree of freedom.

4. The refrigerator according to claim 3, wherein:

the forcing unit includes a rod fixing portion provided in the opposite end; and the second shaft unit includes a socket coupled with the rod fixing portion, a ball screw to allow movement of the socket, and a bracket to fix the ball screw.

5. The refrigerator according to claim 4, wherein the socket includes a movement space to assure movement thereof on the ball screw.

6. The refrigerator according to claim 3, wherein:

the forcing unit includes a shaft hole defined in the end; and the first shaft unit includes a shaft boss rotatably inserted into the shaft hole and a shaft bolt fastened with the shaft boss to prevent the shaft boss from being released from the shaft hole.

7. The refrigerator according to claim 1, wherein the forcing unit rotationally reciprocates in linkage with the door and the basket.

8. The refrigerator according to claim 1, wherein the sliding unit includes a plurality of rail parts to slide relative to each other, and wherein the lateral wall of the body is provided with a first bracket to which one of the plurality of rail parts is installed, and the lateral wall of the basket is provided with a second bracket to which the other of the plurality of rail parts is installed.

9. The refrigerator according to claim 1, wherein the bracket comprises a hole into which the forcing unit is inserted.

10. A refrigerator comprising:

a body having a storage compartment;

a door to open or close the storage compartment;

a sliding unit to linearly reciprocate in linkage with the door; and a forcing unit to rotationally reciprocate in linkage with the sliding unit, the forcing unit comprising a cylinder and a rod partially inserted into the cylinder to move relative to the cylinder, wherein the forcing unit operates the sliding unit via rotational reciprocating motion thereof, to move the door forward or rearward, wherein the forcing unit and the sliding unit include a pair of forcing units and sliding units installed opposite each other in the storage compartment, wherein the refrigerator further comprises a balance regulating unit linking the pair of forcing units to each other, to allow simultaneous operation of both side ends of the door, the balance regulating unit comprising a rigid body to resist twisting, and wherein the rigid body directly connects the cylinders of the pair of forcing units to each other and serves to maintain horizontal balance of the door during opening or closing of the door.

11. The refrigerator according to claim 10, wherein the forcing unit brakes the sliding unit to reduce an opening/closing operation speed of the door.

* * * * *